US009123301B2

(12) United States Patent
Nishizawa

(10) Patent No.: US 9,123,301 B2
(45) Date of Patent: Sep. 1, 2015

(54) ELECTRO-OPTICAL DEVICE

(71) Applicant: Seiko Epson Corporation, Tokyo (JP)

(72) Inventor: Masato Nishizawa, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/039,419

(22) Filed: Sep. 27, 2013

(65) Prior Publication Data

US 2014/0062850 A1 Mar. 6, 2014

Related U.S. Application Data

(62) Division of application No. 13/026,345, filed on Feb. 14, 2011, now Pat. No. 8,581,834.

(30) Foreign Application Priority Data

Mar. 8, 2010 (JP) ..... 2010-050773

(51) Int. Cl.
*G09G 3/34* (2006.01)
*G09G 5/00* (2006.01)

(52) U.S. Cl.
CPC ..... *G09G 3/344* (2013.01); *G09G 3/34* (2013.01); *G09G 5/00* (2013.01)

(58) Field of Classification Search
CPC ..... G09G 3/344
USPC ..... 345/107, 208, 211; 359/296
See application file for complete search history.

(56) References Cited

U.S. PATENT DOCUMENTS

| | | | | |
|---|---|---|---|---|
| 5,926,159 | A | 7/1999 | Matsuzaki et al. | |
| 7,545,398 | B2 | 6/2009 | Sawada | |
| 7,786,974 | B2 * | 8/2010 | Zhou et al. | 345/107 |
| 2002/0033792 | A1 | 3/2002 | Inoue | |
| 2005/0140576 | A1 | 6/2005 | Sawada et al. | |
| 2005/0184975 | A1 * | 8/2005 | Sawada | 345/204 |
| 2006/0187185 | A1 | 8/2006 | Yoshinaga et al. | |
| 2007/0085819 | A1 | 4/2007 | Zhou et al. | |
| 2007/0279378 | A1 | 12/2007 | Takeuchi et al. | |
| 2008/0043028 | A1 * | 2/2008 | Tanaka | 345/501 |
| 2008/0048968 | A1 * | 2/2008 | Okada et al. | 345/107 |
| 2008/0277279 | A1 * | 11/2008 | Hirayama et al. | 204/406 |
| 2008/0291184 | A1 * | 11/2008 | Zhou et al. | 345/205 |
| 2009/0237351 | A1 | 9/2009 | Kanamori et al. | |
| 2010/0245375 | A1 * | 9/2010 | Rhodes | 345/589 |

FOREIGN PATENT DOCUMENTS

| | | |
|---|---|---|
| JP | 05-323281 | 12/1993 |
| JP | 2002-149115 A | 5/2002 |
| JP | 2009-186549 A | 8/2009 |
| JP | 2009-192786 A | 8/2009 |
| JP | 2009-204812 A | 9/2009 |
| JP | 2010-044508 A | 2/2010 |

* cited by examiner

*Primary Examiner* — Hong Zhou

(74) *Attorney, Agent, or Firm* — Harness, Dickey & Pierce, P.L.C.

(57) ABSTRACT

An electro-optical device includes: a display section that has a plurality of pixels; a control value acquisition section that acquires an initial value of a control value c which is used when an image is displayed on the display section; a calculation section that decreases the control value c whenever the image of the display section is rewritten; and a control section that selects one driving method from a plurality of driving methods on the basis of the control value c and rewrites the image of the display section by using the selected driving method.

14 Claims, 9 Drawing Sheets

SQ11 [ INVERTED ALL-BLACK CLEAR ] → [ ALL-WHITE CLEAR ] → [ BLACK COMPONENT WRITE ]

SQ12A [ INVERTED ALL-BLACK CLEAR ] → [ WHITE COMPONENT WRITE ]

SQ12B [ INVERTED ALL-WHITE CLEAR ] → [ BLACK COMPONENT WRITE ]

SQ13 [ DIFFERENCE WRITE ]

SQ21 [ INVERTED ALL-BLACK CLEAR ] → [ ALL-WHITE CLEAR ] → [ BLACK COMPONENT WRITE ]

SQ22A [ INVERTED ALL-BLACK CLEAR ] → [ WHITE COMPONENT WRITE ]

SQ22B [ INVERTED ALL-WHITE CLEAR ] → [ BLACK COMPONENT WRITE ]

SQ31 [ INVERTED ALL-BLACK CLEAR ] → [ ALL-WHITE CLEAR ] → [ BLACK COMPONENT WRITE ]

SQ32 [ DIFFERENCE WRITE ]

ELECTRO-OPTICAL DEVICE

CROSS-REFERENCE TO RELATED APPLICATIONS

This is a divisional patent application of U.S. application Ser. No. 13/026,345 filed Feb. 24, 2011 which claims priority to Japanese Patent Application No. 2010-050773 filed Mar. 8, 2010 all of which are incorporated by reference herein in their entireties.

BACKGROUND

1. Technical Field

The present invention relates to an electro-optical device.

2. Related Art

In electrophoresis display devices as one type of the electro-optical devices having storage-type display elements, when a display image on the display section is updated, the following operation is performed throughout plural frames: an image (a previous image) before the update is cleared, for example, the entire screen is displayed in white; and then a black display part is written in the next display image (for example, refer to JP-A-2002-149115).

However, in the driving method, there is a problem in that, in order to perform the operation for writing an identical image on the display section multiple times, it takes time to update the display, and particularly it takes more time if the number of pixels of the display section is large. For this reason, there is a problem in that it is difficult to continuously display plural images while updating the images at a high speed. In the present description, displaying the plural images continuously is referred to as a continuous display.

SUMMARY

An advantage of some aspects of the invention is to provide an electro-optical device capable of high-speed continuous display and a driving method therefor.

According to an embodiment of the invention, an electro-optical device includes: a display section that has a plurality of pixels; a control value acquisition section that acquires an initial value of a control value c which is used when an image is displayed on the display section; a calculation section that decreases the control value c whenever the image of the display section is rewritten; and a control section that selects one driving method from a plurality of driving methods on the basis of the control value c and rewrites the image of the display section using the selected driving method.

With such a configuration, on the basis of the value of the control value c which is decreased when the image is rewritten, the method of driving the display section is selected. Therefore, when the images are continuously rewritten, it is possible to select an appropriate driving method in accordance with the remaining number of times the image is to be rewritten. Accordingly, for example, in the case where the remaining number of times the image is to be rewritten is large, it is possible to select the driving method capable of the high-speed image display as compared with the case where the remaining number of times the image is to be rewritten is small. In other words, in the case where the control value c is large, it is possible to select the driving method capable of high-speed image display as compared with the case where the control value c is small. As a result, it is possible to embody an electro-optical device capable of high-speed continuous display.

It is preferable that the driving method, which is selected from the plurality of driving methods when the control value c is equal to a predetermined lower limit, should have a lower speed than the driving method which is selected when the control value c is a value different from the lower limit.

Normally, when the speed of the image rewriting is increased, the period during which a voltage is applied to the electro-optical material layer decreases or the applied voltage decreases, and thus display quality deteriorates. Accordingly, with the above-mentioned configuration, when the control value c is the lower limit, the driving method, which has a lower speed than that in the case where the control value c is a value different from the lower limit, is selected, and thereby it is possible to obtain high-quality display in the final image display which is display not changed any more thereafter. Thereby, it is possible to satisfy both high-speed continuous display and high-quality display.

It is preferable that the control value c should be an integer and one pixel of the plurality of pixels should have a first electrode, a second electrode that is opposed to the first electrode, and an electro-optical material layer that is interposed between the first electrode and the second electrode. It is also preferable that the control section should have a first driving method of executing a first clear operation, a second clear operation, and an image display operation, a second driving method of executing a clear operation and the image display operation, and a third driving method of executing a difference image display operation which displays a difference image between a new image and the image displayed on the display section. In addition, it is also preferable that, in rewriting the image the number of times corresponding to the initial value of the control value c, the first driving method should be selected when the control value c is equal to or more than a predetermined value L (L is an arbitrary integer) and less than a predetermined value M (M is an integer equal to or more than L+1), the second driving method should be selected when the control value c is equal to or more than the predetermined value M and less than a predetermined value N (N is an integer equal to or more than M+1), and the third driving method should be selected when the control value c is equal to or more than the predetermined value N.

In such a configuration, plural pages may be continuously displayed. In this case, if the control value c corresponding to the remaining number of times the image is to be rewritten is large, display is performed at a relatively high speed. In contrast, if the control value c is small (the rest of the number of times is small), display can be performed at a relatively low speed but with high quality. Therefore, it is possible to satisfy both high-speed continuous display and high-quality display.

It is preferable that the control value c should be an integer and one pixel of the plurality of pixels should have a first electrode, a second electrode that is opposed to the first electrode, and an electro-optical material layer that is interposed between the first electrode and the second electrode.

It is also preferable that the control section should have a first driving method of executing a first clear operation, a second clear operation, and an image display operation, and a second driving method of executing a clear operation and the image display operation. In addition, it is also preferable that, in rewriting the image the number of times corresponding to the initial value of the control value c, the first driving method should be selected when the control value c is equal to or more than a predetermined value L (L is an arbitrary integer) and less than a predetermined value M (M is an integer equal to or more than L+1), and the second driving method should be selected when the control value c is equal to or more than the predetermined value M.

In such a configuration, the plural pages may be continuously displayed. In this case, if the control value c corresponding to the remaining number of times the image is to be rewritten is large, display is performed at a relatively high speed. In contrast, if the control value c is small (the rest of the number of times is small), display can be performed at a relatively low speed but with high quality. Therefore, it is possible to satisfy both high-speed continuous display and high-quality display.

It is preferable that the second driving method should include a first mode of executing the clear operation, which changes the entire display section to a first gray level, and executing the image display operation which changes at least some pixels of the plurality of pixels to a second gray level different from the first gray level, and a second mode of executing the clear operation, which changes the entire display section to the second gray level, and executing the image display operation which changes the at least some pixels of the plurality of pixels to the first gray level.

In such a configuration, between the first mode and the second mode, there is only a difference in the gray levels of the pixels driven for each operation. However, in accordance with the kind of electro-optical material layer, a display state or visibility of the display section may be different between the first mode and the second mode. Accordingly, in the configuration with both of the first and second modes, it is possible to use the first and second modes in a way of switching from one to the other in accordance with the display image data or characteristics of the electro-optical material layer. Hence, it is possible to achieve high quality display.

It is preferable that the control value c should be an integer and one pixel of the plurality of pixels should have a first electrode, a second electrode that is opposed to the first electrode, and an electro-optical material layer that is interposed between the first electrode and the second electrode. It is also preferable that the control section should have a first driving method of executing a first clear operation, a second clear operation, and an image display operation while switching the electric potential of the second electrode depending on the displayed gray level, and a second driving method of executing a difference image display operation which writes a difference image between an image being displayed on the display section and an image to be subsequently displayed while maintaining the second electrode at a constant electric potential. In addition, it is also preferable that, in rewriting the image the number of times corresponding to the initial value of the control value c, the first driving method should be selected when the control value c is equal to or more than a predetermined value L (L is an arbitrary integer) and less than a predetermined value M (M is an integer equal to or more than L+1), and the second driving method should be selected when the control value c is equal to or more than the predetermined value M.

In such a configuration, plural pages may be continuously displayed. In this case, if the control value c corresponding to the remaining number of times the image is to be rewritten is large, display is performed at a relatively high speed. In contrast, if the control value c is small (the rest of the number of times is small), display can be performed at a relatively low speed but with high quality. Therefore, it is possible to satisfy both high-speed continuous display and high-quality display.

It is preferable that the control value acquisition section should measure input signal pulses, which are supplied from an input device connected to the electro-optical device, during a predetermined period, and should set the initial value of the control value c on the basis of the number of pulses measured.

With such a configuration, it is possible to set the initial value of the control value c in accordance with the rotation angle of a jog dial or the number of times a button constituting the input device is pressed.

It is preferable that the first driving method should have a lower speed than the driving method which is selected from the plurality of driving methods when the control value c is equal to or more than the predetermined value M.

With such a configuration, it is possible to perform display at a relatively low speed but with high quality when the control value c is small.

It is preferable that the predetermined value L should be 1.

With such a configuration, as the driving method which is applied when the fixed display image is written, it is possible to provide a driving method capable of performing display at a relatively low speed but with high quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, an electro-optical device according to an embodiment of the invention will be described with reference to the accompanying drawings.

It should be noted that the scope of the invention is not limited to the following embodiment but may be optionally modified within the technical scope of the invention. Further, in the following drawings, in order to facilitate the understanding of each configuration, the dimensions and the scales of the structures may be different from those of the actual structure.

The electrophoresis display device according to the embodiment is an electronic book reader capable of reading an electronic book or the like formed of documents divided into predetermined pages.

Figure 1:
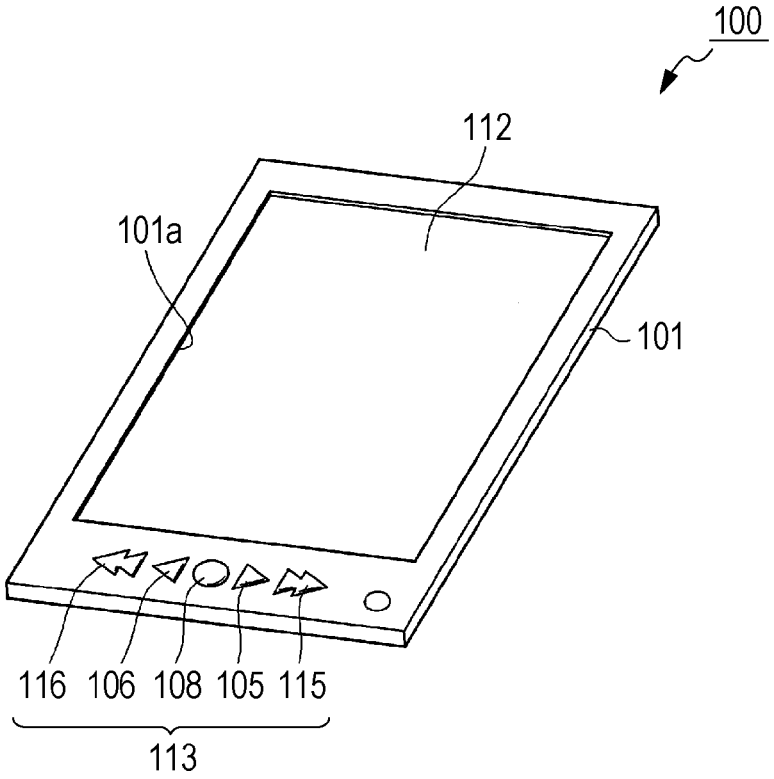
FIG. 1 is an appearance diagram of an electronic book reader according to a first embodiment.
Figure 2:
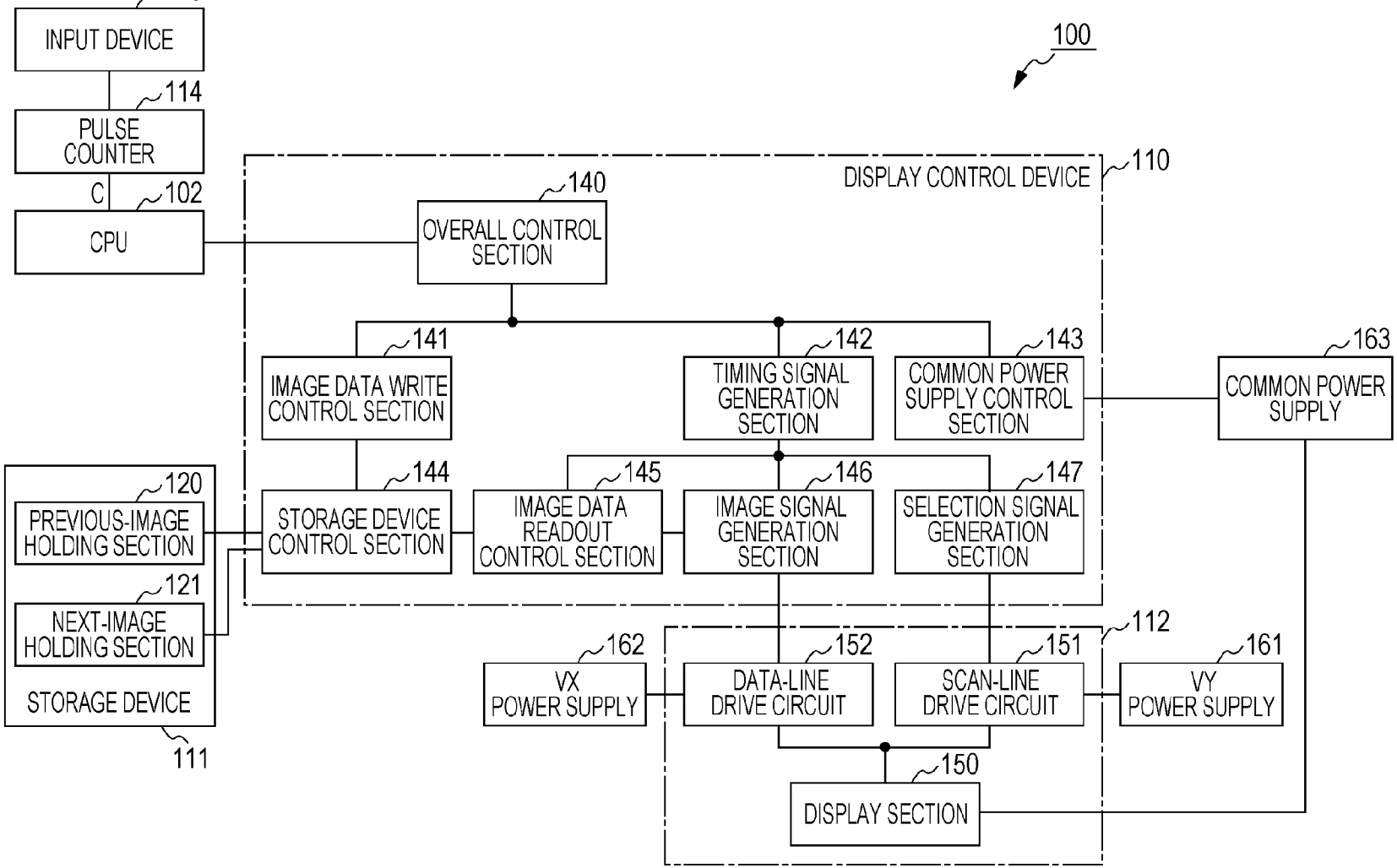
FIG. 2 is a diagram illustrating an internal configuration of the electronic book reader.

FIG. 1 is an appearance diagram of the electronic book reader 100 according to the embodiment. FIG. 2 is a block diagram illustrating an internal configuration of the electronic book reader 100 according to the embodiment.

As shown in FIG. 1, the electronic book reader 100 has a casing 101 and an electro-optical panel 112 which is mounted on a rectangular opening portion 101*a* formed on one surface of the casing 101. The casing 101 is provided with a page forward button 105, a page backward button 106, a decision button 108, a skip forward button 115, and a skip backward button 116.

The page forward button 105 is an operation section that activates a function of displaying following pages of a document (an image) currently displayed on the electro-optical panel 112 by turning one page forward each time the button is pressed once. The page backward button 106 is an operation section for activating a function of displaying previous pages of the document by turning one page back each time the button is pressed once.

The skip forward button 115 is an operation section for activating a function of displaying a page, to which the display skips forward for example 10 pages, each time the button is pressed once. The skip backward button 116 is an operation section for activating a function of displaying a page to which the display skips back, for example, 10 pages each time the button is pressed once. The numbers of pages skipped by the skip forward button 115 and the skip backward button 116 may be set arbitrarily.

The electronic book reader 100 includes, as shown in FIG. 2, a CPU (Central Processing Unit; a control section, a calculation section) 102, a display control device 110, a storage device 111, an electro-optical panel 112, an input device 113, a pulse counter 114, a VY power supply 161, a VX power supply 162, and a common power supply 163.

In addition, the CPU 102 shown in FIG. 2 is connected to a work memory and a program memory which are not shown in the drawing. The work memory is a RAM (Random Access Memory) constituting a work area of the CPU 102, and the program memory is a ROM (Read Only Memory) for holding various programs. The work memory and the program memory may be included in the storage device 111, or may be provided as storage devices separated from the storage device 111. Alternatively, the work memory and the program memory may be configured to be built in the CPU 102.

The CPU 102 reads the data and the various programs such as application programs and basic control programs stored in the program memory, develops those data and various programs in the work area which is provided in the work memory (not shown), and controls the respective sections belonging to the electronic book reader. Further, in the embodiment, while displaying plural pages continuously, the CPU 102 also calculates a control value c corresponding to the remaining number of times the image is to be rewritten. Thus, the CPU 102 also functions as a calculation section that decreases the control value c whenever an image is rewritten.

The CPU 102 is connected to the display control device 110 and the pulse counter 114. The display control device 110 is connected to the electro-optical panel 112 and common power supply 163, and the electro-optical panel 112 is connected to the VY power supply 161 and the VX power supply 162. On the other hand, the pulse counter 114 is connected to the input device 113.

The input device 113 includes the page forward button 105, the page backward button 106, the decision button 108, the skip forward button 115, and the skip backward button 116 shown in FIG. 1. When any one button is operated (pressed), the signal (the pulse) corresponding to the pressed button is output to the pulse counter 114.

The pulse counter 114 is a control value acquisition section that acquires an initial value of the control value c. The pulse counter 114 counts input pulses, which are input from the input device 113, during a predetermined period, and outputs the obtained count value as the control value c to the CPU 102. For example, the pulse counter 114 can be configured to have a control circuit that outputs the storage area, which is for storing the number of times the button of the input device 113 is pressed within the predetermined period, and the count value, which is held in the storage area, to the CPU 102 in response to the request issued from the CPU 102 or for each predetermined period. The count value held in the storage area is cleared whenever the control value c is output.

It should be noted that the pulse counter 114 is not limited to the above-mentioned configuration in which the control value is output as the control value c as it is (the configuration in which the count value corresponds one-to-one with the number of pages turned forward). For example, the pulse counter 114 may be configured to convert the input pulses on the basis of a prescribed conversion algorithm and output the converted value as the control value c to the CPU 102. In the present example, since the count value is output as is as the control value c, c is an integer.

For example, the input device 113 may be a device, which outputs multiple pulses, such as a jog dial. In this case, if the number of output pulses is set to be equal to the number of pages turned forward, sometimes the number of pages may become excessively large. In such a case, it is preferable to set the control value c by changing the count value so as to make the plural pulses correspond to one page.

The display control device 110 has an overall control section 140, an image data write control section 141, a timing signal generation section 142, a common power supply control section 143, a storage device control section 144, an image data readout control section 145, an image signal generation section 146, and a selection signal generation section 147.

The overall control section 140 is connected to the image data write control section 141, the timing signal generation section 142, and the common power supply control section 143. The image data write control section 141 is connected to the storage device control section 144. The timing signal generation section 142 is connected to the image data readout control section 145, the image signal generation section 146, and the selection signal generation section 147. The common power supply control section 143 is connected to a common power supply 163.

The display control device 110 is connected to the CPU 102 in the overall control section 140, is connected to the electro-optical panel 112 in the image signal generation section 146 and the selection signal generation section 147, and is connected to the storage device 111 in the storage device control section 144.

The storage device 111 includes a previous-image holding section 120 and a next-image holding section 121 both of which are formed by RAM. The previous-image holding section 120 is a storage area for holding data (the image data corresponding to the currently displayed image) of an image displayed on the electro-optical panel 112. The next-image holding section 121, and is a storage area for holding data (the image data corresponding to the updated image) of an image to be displayed next time on the electro-optical panel 112.

Both of the previous-image holding section 120 and the next-image holding section 121 are connected to the storage device control section 144 of the display control device 110. Thus, the display control device 110 reads and writes the image data from and into the storage device 111 through the storage device control section 144.

The electro-optical panel 112 includes a display section 150 having storage display elements such as electrophoretic elements or cholesteric liquid crystal elements. The electro-optical panel 112 further includes a scan-line drive circuit 151 and a data-line drive circuit 152 which are connected to the display section 150. The display section 150 is connected to the common power supply 163. The scan-line drive circuit 151 is connected to the VY power supply 161 and the selection signal generation section 147 of the display control device 110. The data-line drive circuit 152 is connected to the VX power supply 162 and the image signal generation section 146 of the display control device 110.

Figure 3:
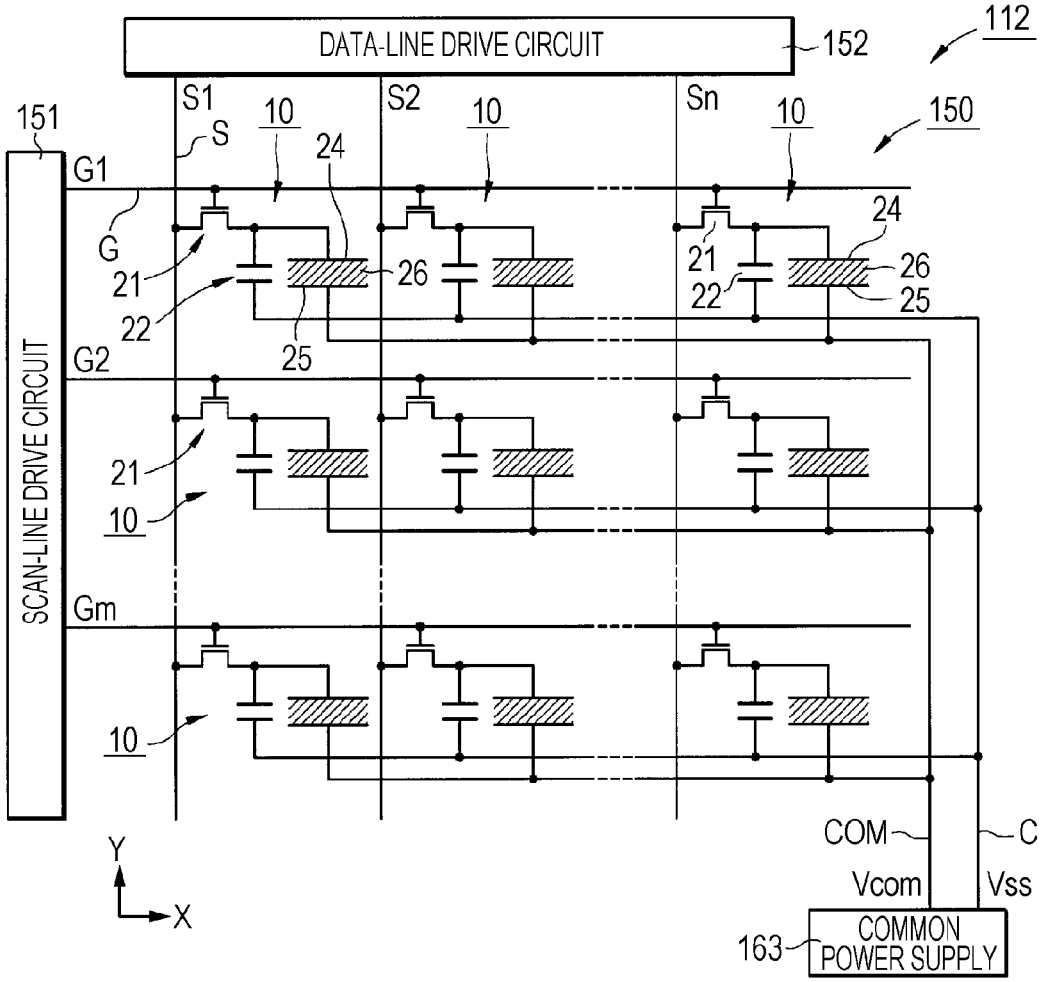
FIG. 3 is a diagram illustrating an electric configuration of an electro-optical panel.

Here, FIG. 3 is a diagram illustrating an electric configuration of the electro-optical panel 112.

In the display section 150 of the electro-optical panel 112, as shown in FIG. 3, there are formed plural scan lines G (G1, G2, . . . , Gm), which extends in the X axis direction shown in the drawing, and plural data lines S (S1, S2, . . . , Sn) which extends in the Y axis direction. Pixels 10 are formed to correspond to the intersection portions between the scan lines G and the data lines S. The pixels 10 are arranged in a matrix with m rows in the Y axis direction and n columns in the X axis direction, and each pixel 10 is connected to each scan line G and each data line S. Further, in the display section 150, there are formed common electrode wires COM and capacity lines C which extend from the common power supply 163.

In each pixel 10, there are formed, as pixel switching elements, a selection transistor 21, a holding capacitor 22, a pixel electrode 24, a common electrode 25, and an electro-optical material layer 26.

The selection transistor 21 is constituted by an N-MOS (Negative-channel Metal Oxide Semiconductor) TFT. The gate of the selection transistor 21 is connected to the scan line G, the source thereof is connected to the data line S, and the drain thereof is connected to one electrode of the holding capacitor 22 and the pixel electrode 24.

The holding capacitor 22 is formed of a pair of electrodes which are disposed to face each other with a dielectric film interposed therebetween. One electrode of the holding capacitor 22 is connected to the drain of the selection transistor 21, and the other electrode thereof is connected to the capacity line C. The holding capacitor 22 is able to hold the image signal, which is written through the selection transistor 21, only for a predetermined period.

The electro-optical material layer 26 is formed of electrophoretic elements, cholesteric liquid crystal elements, electronic particle elements, or the like. Examples of the electrophoretic element includes an element, in which micro capsules encapsulating electrophoretic particles and dispersion medium are arranged, and an element in which electrophoretic particles and dispersion medium are encapsulated by spaces divided by division walls and a substrate.

The scan-line drive circuit 151 is connected to the scan lines G formed in the display section 150, and is connected to the pixels 10 at the respective corresponding rows through the respective scan lines G. On the basis of the timing signal supplied through the selection signal generation section 147 from the timing signal generation section 142 shown in FIG. 2, the scan-line drive circuit 151 sequentially supplies the selection signals, which are generated for the respective scan lines G1, G2, . . . , Gm by the selection signal generation section 147, as pulses, and exclusively sets each scan line G to a selected state one after another. The selected state is a state where the selection transistor 21 connected to the scan line G is on.

The data-line drive circuit 152 is connected to the data lines S formed in the display section 150, and is connected to the pixels 10 at the respective corresponding columns through the respective data lines S. On the basis of the timing signal supplied through the image signal generation section 146 from the timing signal generation section 142, the data-line drive circuit 152 supplies the image signals which are generated for the respective data line S1, S2, . . . , Sn by the image signal generation section 146.

In the operation description which will be given later, it is assumed that each image signal has a binary potential of a high-level potential VH (for example, 15V) or a low-level potential VL (for example 0V or −15V). Further, in the embodiment, it is assumed that the pixels 10 displayed in black (a first gray level) are supplied with the high-level image signal (VH), and the pixels 10 displayed in white (a second gray level) are supplied with the low-level image signal (VL).

Further, a common electrode 25 is supplied with a common electrode potential Vcom from the common power supply 163, and the capacity line C is supplied with a capacity line potential Vss from the common power supply 163.

However, in the description of the driving method to be given later, for convenience of description, it is assumed that the common electrode potential Vcom has the binary potential of the low-level potential VL (for example 0V or −15V) or the high-level potential VH (for example, 15V). In addition, it is assumed that the capacity line potential Vss is fixed to a reference potential (for example 0V).

It should be noted that the embodiment shows the active matrix type electro-optical panel 112 having the scan-line drive circuit 151 and the data-line drive circuit 152. However, as the electro-optical panel 112, a passive matrix type or segment drive type electro-optical panel may be used.

Document Display Operation

Next, a document display operation of the electronic book reader will be described with reference to the accompanying drawings.

The electronic book reader 100 according to the embodiment is able to continuously display plural pages one after another even when the button in the input device 113 is successively pressed multiple times. More specifically, when the instruction to continuously page forward (page backward) is input, the control value c representing the number of times of image rewriting is acquired, and the control value c is decreased whenever an image is rewritten. When the image is rewritten, that is, when the next page is displayed, a different drive sequence (driving method) is set in accordance with the control value c, and image display is performed by using such a drive sequence. Thereby, while the images are displayed at a high speed during the operation for continuously paging forward, it is possible to obtain high quality display at the final page fixedly displayed by the paging forward.

Figure 4:
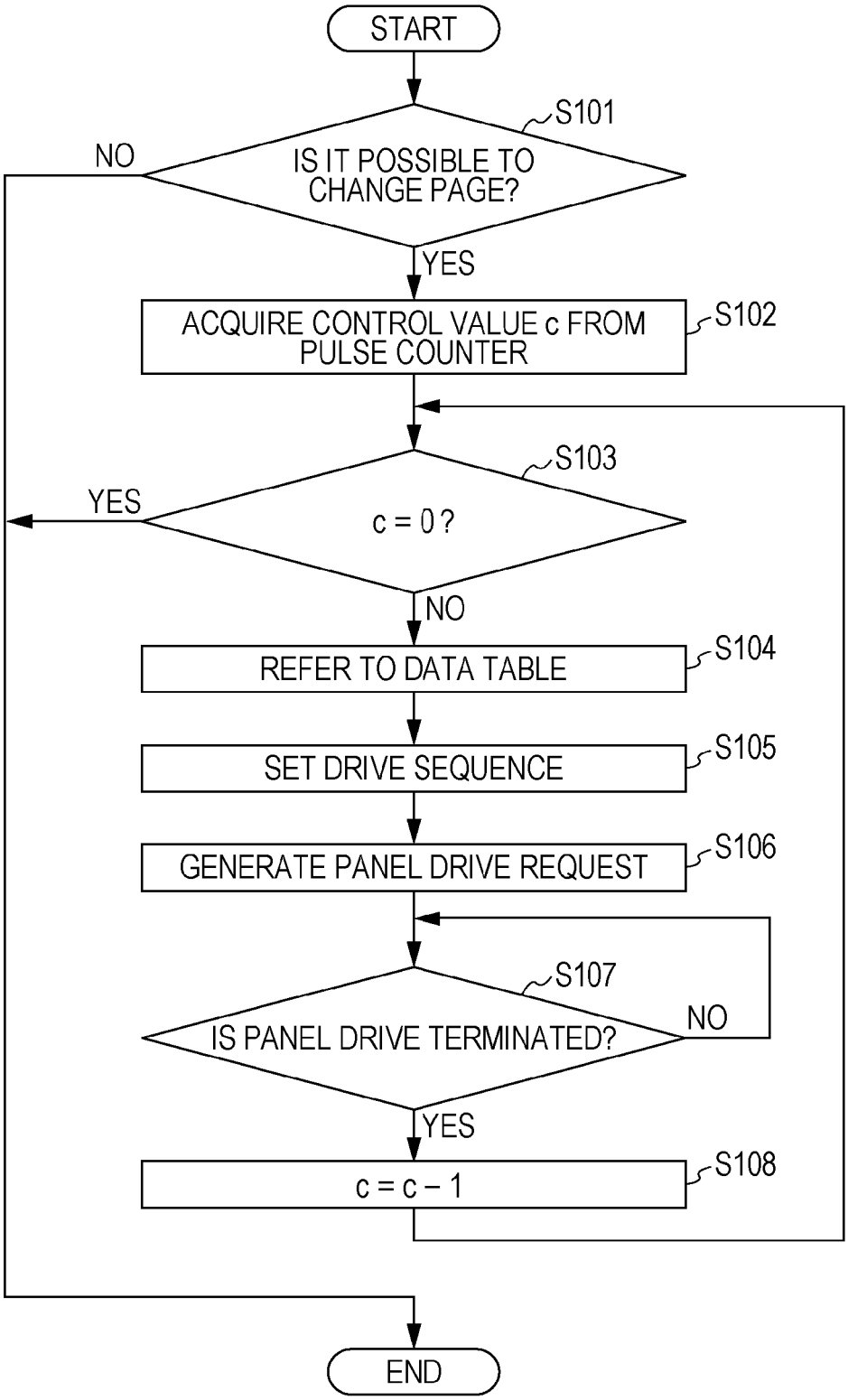
FIG. 4 is a flowchart of the page change process in the electronic book reader.
Figure 5:
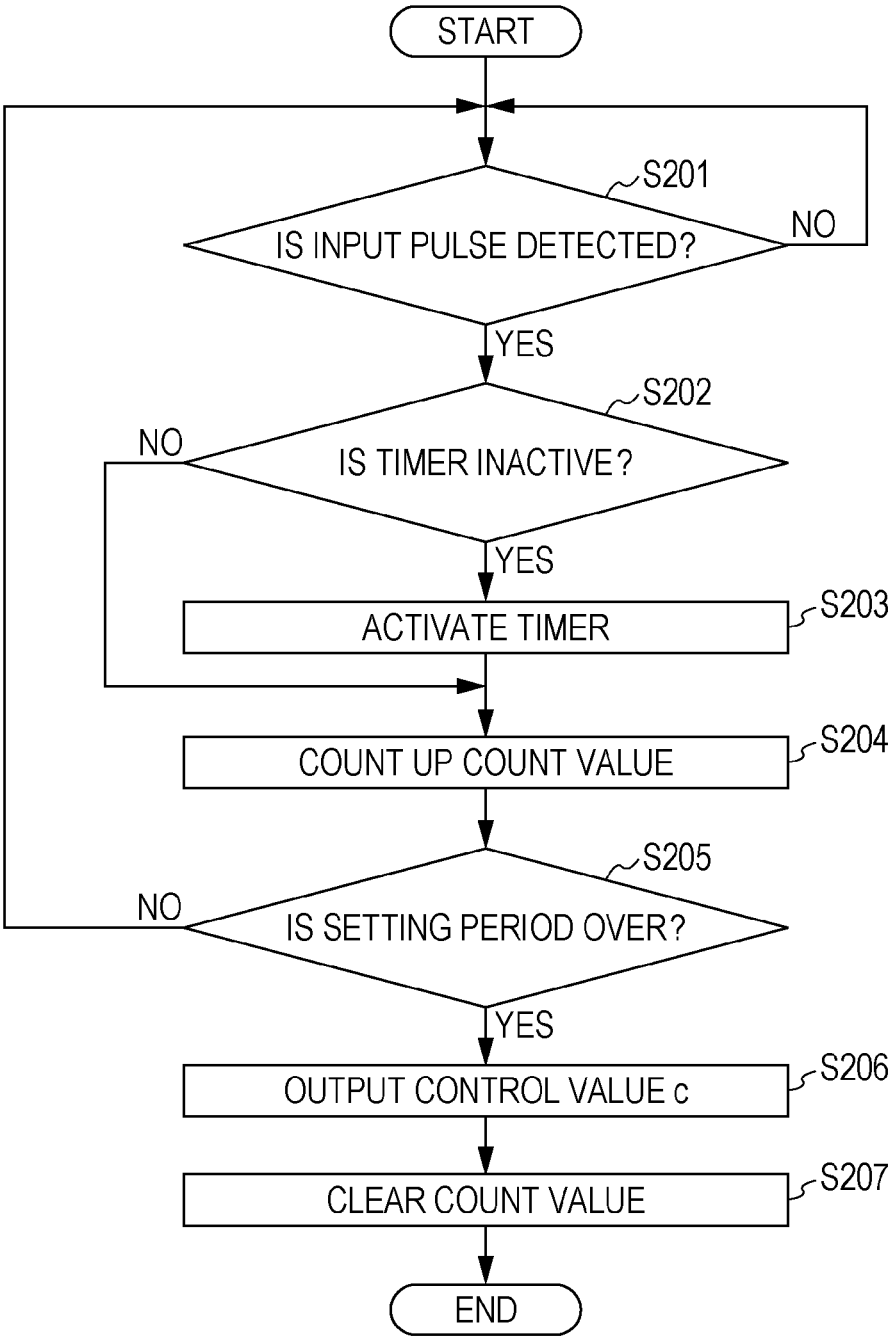
FIG. 5 is a diagram illustrating a flow of operations of a pulse counter.

FIG. 4 is a flowchart of a page change process in the electronic book reader 100 according to the embodiment. FIG. 5 is a diagram illustrating an operation flow of the pulse counter. FIGS. 6A to 6D are diagrams illustrating drive waveforms of the respective operations constituting the drive sequence.

The page change process of the embodiment is a process which is executed at the time of operating the input device 113 (the page forward button 105, the page backward button 106, the skip forward button 115, the skip backward button 116, or the like) shown in FIG. 1. Alternatively, the page change process of the embodiment may be executed only if the button is successively pressed multiple times in the input device 113.

In addition, it is apparent that the image, which is displayed on the electro-optical panel 112 in the page change process, becomes different in accordance with the kind of the button operated in the input device 113.

For example, when the page forward button 105 of the input device 113 is pressed multiple times, the following pages of the document are displayed one after another by the number (the control value c) corresponding to the number of times the button is pressed. Further, when the page backward button 106 of the input device 113 is pressed multiple times, the previous pages of the document are displayed one after another by the number (the control value c) corresponding to the number of times the button is pressed.

Moreover, when the skip forward button 115 of the input device 113 is pressed multiple times, the page when 10 pages are skipped forward is displayed first, and then pages are sequentially turned forward by skipping 10 pages at a time. Here, the number of times the pages are sequentially turned forward is the number (the control value c) which corresponds to the number of times the button is pressed. When the skip backward button 116 of the input device 113 is pressed multiple times, the page when 10 pages are skipped back is displayed first, and then pages are sequentially turned back by skipping 10 pages at a time. Here, the number of times the pages are sequentially turned back is the number (the control value c) which corresponds to the number of times the button is pressed.

In this example, when the control value c (an integer) is positive, the paging forward is performed, but when the control value c is 0 (zero) or negative, the paging forward is not performed. In other words, since the lower limit of the control value c for rewriting an image is set to 1, in any case, the number of time of image rewriting is equal to c.

Hereinafter, referring to FIGS. 4 to 6D, the page change process of the embodiment will be described in detail. However, in the following description, in order to facilitate the understanding of the embodiment of the invention, description will be given under the assumption that the electro-optical material layer 26 is an electrophoretic element.

Figure 7A:
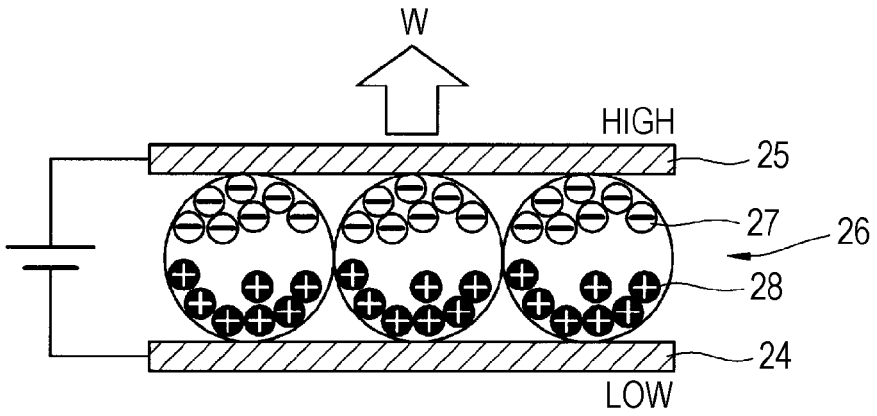
FIG. 7A is an explanatory diagram of an operation of an electrophoretic element.
Figure 7B:
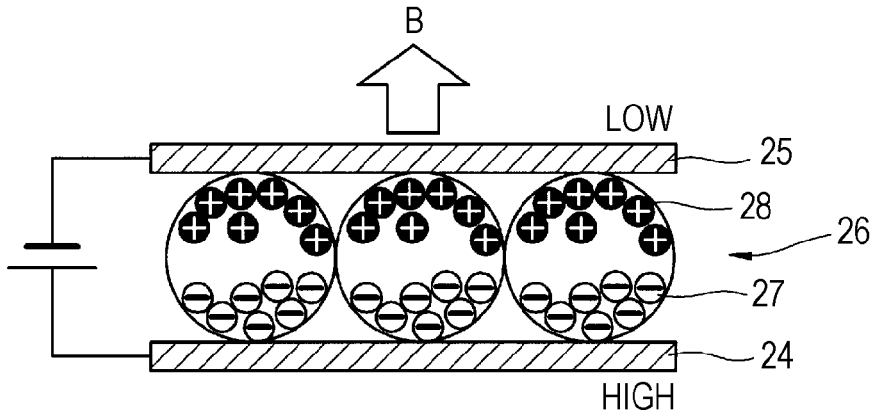
FIG. 7B is an explanatory diagram of an operation of the electrophoretic element.

FIGS. 7A and 7B are explanatory diagrams of the operations of the electrophoretic element. FIG. 7A shows the case where pixels are displayed in white, and FIG. 7B shows the case where the pixels are displayed in black.

In the case of the white display shown in FIG. 7A, the common electrode 25 is held at a relatively high potential, and the pixel electrode 24 is held at a relatively low potential. Thereby, negatively charged white particles 27 can be attracted to the common electrode 25, while positively charged black particles 28 can be attracted to the pixel electrode 24. As a result, as the pixels are viewed from the common electrode 25 side which is the display screen side, the color white (W) is visualized.

In the case of the black display shown in FIG. 7B, the common electrode 25 is held at a relatively low potential, and the pixel electrode 24 is held at a relatively high potential. Thereby, positively charged black particles 28 can be attracted to the common electrode 25, while negatively charged white particles 27 can be attracted to the pixel electrode 24. As a result, as the pixels are viewed from the common electrode 25 side, the color black (B) is visualized.

The page change process of the embodiment includes steps S101 to S108 shown in FIG. 4.

First, in step S101, the CPU 102 determines whether the electronic book reader 100 is ready to change the page. For example, in a state where an operation menu or a selection dialogue other than a document is displayed on the electro-optical panel 112, the page change is not allowed, and thus the page change process is terminated without change. On the other hand, in a state where a document is displayed on the electro-optical panel 112 of the electronic book reader 100, the page change is allowable. In this case, the process advances to step S102.

Next, in step S102, the CPU 102 acquires the control value c which is output from the pulse counter 114. Subsequently, in step S103, it is determined whether or not the control value c is 0 (zero). If the control value c is 0, the paging forward is not performed, and thus the page change process is terminated without change.

Typically, the control value c is 0 in a case where the calculation result in step S108 to be described later is c=0 (that is, in a case of the end of the continuous display operation (the paging forward) corresponding to the number of pages instructed by a user through the operation of the input device 113.

Besides, for example, the control value c also becomes 0 in the following cases: a button (for example, the decision button 108) other than the button for the page change is pressed; or the input device 113 is a jog dial and the number of pulses output from the jog dial is less than the number of pulses corresponding to the operation of turning one page forward.

In contrast, if the control value c is an integer of 1 or more, the process advances to step S104.

Here, the operation of the pulse counter 114 will be described with reference to FIG. 5.

As shown in FIG. 5, the operation flow of the pulse counter 114 includes steps S201 to S207. In the electronic book reader 100, in order to reduce power consumption, the timer used to measure time in the pulse counter 114 may be inactivated. In such a case, it is necessary to activate the timer when the input device 113 is operated. FIG. 5 shows the operation of the pulse counter 114 including the timer activation.

As shown in step S201 of FIG. 5, the pulse counter 114 monitors the supply of the input pulses from the input device 113. Thus, when detecting the input pulses, the pulse counter 114 executes the process from step S202, thereby outputting the control value c.

When the pulse counter 114 detects the input pulses, the process advances to step S202 to determine the timer state. If it is determined that the timer is inactive, the process advances to step S203, the timer is activated, and then the process advances to step S204. If the timer is already active, the process advances from step S202 to step S204.

In step S204, the input pulses supplied from the input device 113 are counted (the count value held by the pulse counter 114 increases by 1). Subsequently, it is determined that the elapsed time, which is measured by the timer in step S205, exceeds the set time. If the elapsed time is equal to or less than the set time, the process returns to step S201, and the monitoring of the input pulses proceeds. In contrast, if the set time is exceeded, the process advances to step S206, and the control value c is output to the CPU 102 on the basis of the count value. After the control value c is output, the count value is cleared in step S207, and the process ends.

Returning to FIG. 4, in step S104 of the page change process, the CPU 102 specifies the drive sequence (the driving method), which it is necessary to select, with reference to the data table using the acquired control value c.

The following Table 1 is a table showing a simple overview of the data table referenced in step S104. Further, Table 2 is a table showing configurations of the drive sequences shown in Table 1.

TABLE 1

| CONTROL VALUE | DRIVE SEQUENCE |
|---|---|
| $1 \leq c < M$ | SQ11 |
| $M \leq c < N$ | SQ12 |
| $c \geq N$ | SQ13 |

TABLE 2

| DRIVE SEQUENCE | | INVERT CLEAR | ALL-WHITE CLEAR | IMAGE DISPLAY: SINGLE COLOR COMPONENT WRITE | IMAGE DISPLAY: DIFFERENCE WRITE |
|---|---|---|---|---|---|
| SQ11 | | ○ | ○ | ○ | |
| SQ12 | A | ○ (ALL BLACK) | | ○ (WHITE COMPONENT WRITE) | |
| | B | ○ (ALL WHITE) | | ○ (BLACK COMPONENT WRITE) | |
| SQ13 | | | | | ○ |

Vcom = REFERENCE POTENTIAL (GND) FIXED

In Table 1, N is a natural number of 3 or more, and M is a natural number equal to or more than 2 and less than N. These M and N are integers set appropriately, and are not particularly limited.

In the data table shown in Table 1, the control values c are classified into 3 levels, and the respective levels are associated with the drive sequence SQ11, the drive sequence SQ12, and the drive sequence SQ13. The CPU 102 acquires the drive sequences SQ11 to SQ13 corresponding to the levels, to which the control values c belong, with reference to the data table using the control values c acquired in step S102.

For example, when the setting is made so that N=8 and M=4, the drive sequence SQ13 is selected at the control value c of 8 or more, the drive sequence SQ12 is selected at the control value c ranging from 4 to 7, and the drive sequence SQ11 is selected at the control value c ranging from 1 to 3.

Further, when the setting is made so that N=4 and M=2, the drive sequence SQ13 is selected at the control value c of 4 or more, the drive sequence SQ12 is selected at the control value c of 2 or 3, and the drive sequence SQ11 is selected at the control value c of 1.

The drive sequences SQ11 to SQ13 have differences in configurations of operations thereof executed in the electro-optical panel 112 as shown in Table 2. Hereinafter, the respective drive sequences will be described with reference to Table 2 and FIGS. 6A to 6D.

Drive Sequence SQ11

The drive sequence SQ11 is a drive sequence which is selected when the control value c belongs to the first level ($1 \leq c < M$). As shown in Table 2, the drive sequence SQ11 includes an invert clear step (a first clear operation), an all-white clear step (a second clear operation), and an image display step (an image display operation). Further, FIG. 6A shows respective input potentials of the pixel electrode 24 and the common electrode 25 in one of the pixels 10 of the display section 150, where ST11 corresponds to the invert clear step, ST12 corresponds to the all-white clear step, and ST13 corresponds to the image display step.

As described above, since the lower limit of the control value c for rewriting an image is set to 1, when at least the control value c is equal to the corresponding lower limit, the drive sequence SQ11 is selected.

The invert clear step ST11 is an operation which changes the entire screen (all pixels) of the display section 150 such that it is displayed in black by writing black to the pixels, which are being displayed in white, in the image (the previous image) which was being displayed on the electro-optical panel 112 right before the page change process. Thereby, it is possible to clear the previous image. In FIG. 6A, such a clear is represented as the inverted all-black clear.

Figure 6A:
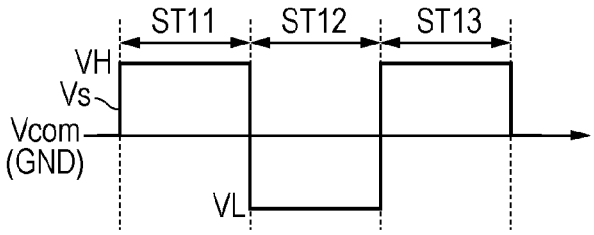
FIG. 6A is a diagram illustrating a drive waveform of an operation constituting a drive sequence.

FIG. 6A shows an input potential for the black display in each pixel 10 in the invert clear step ST11. As shown in the drawing, the high-level potential VH is input to each pixel electrode 24 (the electric potential Vs), and the pixel electrode 24 has a higher potential than each common electrode 25 (the electric potential Vcom) held at the reference potential GND, thereby displaying the pixel 10 in black (refer to FIG. 7B).

In addition, the electric potential (the reference potential) equivalent to the electric potential Vcom of the common electrode 25 is input to the pixel electrode 24 of the pixel 10 which was being displayed in black in the previous image. Then, the pixel 10 keeps being displayed in back.

The all-white clear step ST12 is an operation which displays the entire screen in white by writing white to all the pixels of the display section 150. In the all-white clear step ST12, as shown in FIG. 6A, the low-level potential VL is input to the pixel electrodes 24 of all the pixels 10, and the pixel electrode 24 is held at the electric potential lower than that of the common electrode 25 (the electric potential Vcom) (refer FIG. 7A).

In the image display step ST13, display is performed on the basis of the image data of the image (the next image) to be displayed next time on the display section 150. As shown in Table 2, the image display step ST13 in the drive sequence SQ11 is for writing a single color. Specifically, by writing black to the pixels to be displayed in black in the next image, only the black display part of the next image is displayed on the display section 150 of which the entire screen is displayed in white in the all-white clear step ST12. In FIG. 6A, such a writing operation is represented as black component write. Through the image display step ST13, it is possible to display the next image.

FIG. 6A shows an input potential in each pixel 10 displayed in black in the image display step ST13. In the corresponding pixel 10, the high-level potential VH is input to the pixel electrode 24, the pixel electrode 24 is held at the electric potential higher than that of the common electrode 25. On the other hand, in each pixel 10 which keeps being displayed in white, the reference potential equivalent to the electric potential Vcom of the common electrode 25 is input to the pixel electrode 24.

Drive Sequence SQ12

The drive sequence SQ12 is a drive sequence which is selected when the control value c belongs to the second level ($M \leq c < N$). As shown in Table 2, the drive sequence SQ12 includes the invert clear step (the clear operation) and the image display step (the image display operation).

Figure 6B:
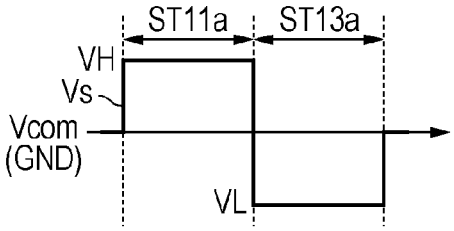
FIG. 6B is a diagram illustrating a drive waveform of an operation constituting the drive sequence.
Figure 6C:
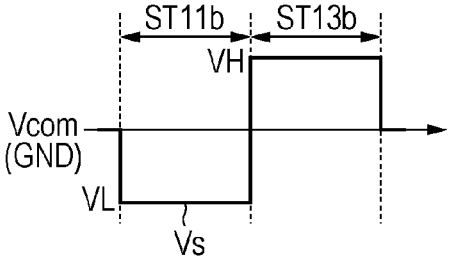
FIG. 6C is a diagram illustrating a drive waveform of an operation constituting the drive sequence.

FIGS. 6B and 6C show two kinds of modes (SQ12A and SQ12B) of the drive sequence SQ12, and show the waveforms of the inputs to the pixel electrode 24 and the common electrode 25 in one of the pixels 10 of the display section 150 in the respective modes. In FIGS. 6B and 6C, ST11*a* and ST11*b* correspond to the invert clear step, and ST13*a* and ST13*b* correspond to image display step.

First, in the invert clear step ST11*a* of the drive sequence SQ12A shown in FIG. 6B, the entire screen (all pixels) of the display section 150 is changed so as to be displayed in black by writing black to the pixels, which are being displayed in white, in the image (the previous image) which was being displayed on the electro-optical panel 112 right before the page change process.

FIG. 6B shows an input potential for the black display in each pixel 10 in the invert clear step ST11*a*. In the corresponding pixel 10, the high-level potential VH is input to each pixel electrode 24 (the electric potential Vs), and the pixel electrode 24 has a higher potential than each common electrode 25 (the electric potential Vcom) held at the reference potential GND. On the other hand, the electric potential (the reference potential) equivalent to the electric potential Vcom of the common electrode 25 is input to the pixel electrode 24 of the pixel 10 which was being displayed in black in the previous image.

Next, in the image display step ST13*a*, display is performed on the basis of the image data of the next image to be displayed on the display section 150. Specifically, by writing white to the pixels to be displayed in white in the next image, the white component (the white display part) of the next image is written in the display section 150 of which the entire screen is displayed in black in the invert clear step ST11*a*. In FIG. 6B, such a writing operation is represented as white component write.

FIG. 6B shows an input potential in each pixel 10 displayed in white in the image display step ST13*a*. In the corresponding pixel 10, the low-level potential VL is input to the pixel electrode 24, the pixel electrode 24 has a lower potential than the common electrode 25 held at the reference potential GND. On the other hand, in each pixel 10 in which there is no change in the display, the reference potential equivalent to the electric potential Vcom of the common electrode 25 is input to the pixel electrode 24.

On the other hand, in the drive sequence SQ12B, the black component of the next image is written in the display section 150, of which the entire screen is displayed in white in the invert clear step ST11*b*, in the image display step ST13*b*. In the drive sequences SQ12A and SQ12B, the correlation between white and black is opposite to each other.

Accordingly, as shown in FIG. 6C, in the invert clear step ST11*b*, the low-level potential VL is input to the pixel electrode 24 of each pixel 10 which is driven (which is displayed in white), and the reference potential GND is input to the pixel electrode 24 of each pixel 10 which is not driven.

In the image display step ST13*b*, the high-level potential VH is input to the pixel electrode 24 of each pixel 10 which is driven (which is displayed in black), and the reference potential GND is input to the pixel electrode 24 of each pixel 10 which is not driven.

The drive sequences SQ12A and SQ12B have following characteristics in common: the clear operation is performed only once; and then an image is displayed. Thus, both are equivalent in the display speed and the power consumption. Accordingly, it is preferable that, in the electronic book reader 100, at least one of the drive sequences SQ12A and SQ12B should be provided.

On the other hand, the drive sequences SQ12A and SQ12B respectively have the following characteristics. Hence, it is preferable that the drive sequences should be settable for each scene in consideration of the characteristic of the modes and the characteristics (the high possibility to cause the image lag and the response speed) of the electro-optical panel 112.

In the drive sequence SQ12A, the image lag is unlikely to occur in the invert clear step ST11*a* since the entire screen of the display section 150 is displayed in black. However, a user tends to have visual contact with the flickering (flashing) on the screen. On the other hand, in the drive sequence SQ12B, the black display part is changed to be displayed in white in the invert clear step ST11*b*. Hence, the image lag tends to occur in the pixels which were being displayed in white in the previous image, but the flashing on the screen is unlikely to occur.

Further, in the description, similarly to the invert clear step ST11, the second gray level, for example, black is written to the pixels, which are being displayed at the first gray level for example in white, in the image (the previous image) which was displayed on the electro-optical panel 112 right before the page change process. In such a manner, the entire screen (all pixels) of the display section 150 is changed to the second gray level. This operation can be expressed as writing of the inverted image. In addition, the writing is not performed on the pixels, which are being displayed at the second gray level, in the image (the previous image) displayed on the electro-optical panel 112 right before the page change process.

Drive Sequence SQ13

The drive sequence SQ13 is a drive sequence which is selected when the control value c belongs to the third level (c≥N). As shown in Table 2, the drive sequence SQ13 includes only the image display step (the image display operation).

In the image display step ST13*c* in the drive sequence SQ13, each pixel 10 is driven on the basis of the difference data between the next image displayed on the display section 150 and the previous image which was being displayed right before that. That is, when the display image is changed from the previous image to the next image, only the pixels 10, of which the gray levels are changed, are driven, and the display state of the pixels 10, of which the gray levels are not changed, is held as it is. Specifically, white is written to the pixels, which will be displayed in white in the next image, among the pixels which were being displayed in black in the previous image. In addition, black is written to the pixels, which will be displayed in black in the next image, among the pixels which were being displayed in white in the previous image. However, the following pixels are not driven, and the display state of the pixels is held as it is: the pixels, which will be still displayed in black in the next image, among the pixels which were being displayed in black in the previous image; and the pixels, which will be still displayed in white in the next image, among the pixels which were being displayed in white in the previous image. In the description, such a writing operation is referred to as difference write or a difference image display operation.

Figure 6D:
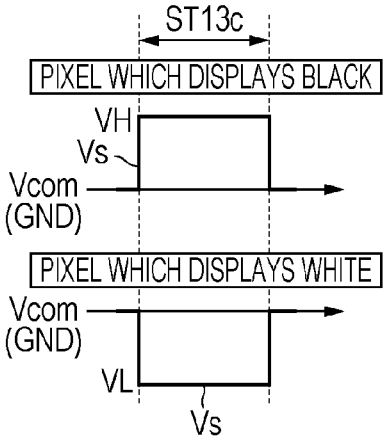
FIG. 6D is a diagram illustrating a drive waveform of an operation constituting the drive sequence.

FIG. 6D shows an input potential in each pixel 10 in the image display step ST13*c* of the drive sequence SQ13. In each pixel 10 which is displayed in black in the image display step ST13*c*, the high-level potential VH is input to each pixel electrode 24 (the electric potential Vs), and the pixel electrode 24 has a relatively higher potential than the common electrode 25 (the electric potential Vcom). On the other hand, in each pixel 10 which is displayed in white, the low-level potential VL is input to the pixel electrode 24, and the pixel electrode 24 has a relatively lower potential than the common electrode 25. Thereby, by simultaneously driving the pixels 10 of the black display part and the pixels 10 of the white display part, it is possible to simultaneously clear the previous image and write the next image.

In the drive sequence SQ13, since the next image is displayed in a way of overwriting the display image of the display section 150 without a separate clear step, it is possible to change images at a relatively high speed. On the other hand, since only the pixels 10 of which the gray levels are different are rewritten, in a case of driving through the drive sequence SQ13, the image lag is highly likely to occur as compared with a case of driving through the drive sequence SQ11.

The process returns to FIG. 4 again. In the page change process of the embodiment, the CPU 102 refers to the table (Table 1) by using the control value c in step S104 shown in FIG. 4, and sets the drive sequence acquired in the table in the subsequent step S105.

When the drive sequence is set in step S105, the CPU 102 determines the image data for performing display on the basis of the information on the operated button in the subsequent step S106, generates a panel drive request including the corresponding image data and the set value of the drive sequence, and outputs them to the display control device 110. Thereafter, the process advances to step S107, and then the CPU 102 monitors whether or not the image display operation on the electro-optical panel 112 is completed, and suspends the process until the panel drive is terminated.

On the other hand, the display control device 110 receiving the panel drive request displays the image data of the next image, which is included in the panel drive request, on the electro-optical panel 112, on the basis of the drive sequence which is set in the panel drive request.

Here, description will be given of an operation that displays an image on the electro-optical panel 112. In the following description, it is assumed that, in the panel drive request which is output to the display control device 110, the drive sequence SQ11 is set.

In the above-mentioned example, the overall control section 140 of the display control device 110 outputs the image data of the received next image to the image data write control section 141, and outputs a command, which is for executing the invert clear step ST11 of the drive sequence SQ11, to the timing signal generation section 142 and the common power supply control section 143.

The image data write control section 141 causes the storage device control section 144 to store the image data of the received next image in the next-image holding section 121 of the storage device 111. At this time, the previous-image holding section 120 holds the image data on the currently displayed page of the document.

The timing signal generation section 142 outputs, to the image data readout control section 145, a command to read out the image data (the image data of the previous image), which is used in the invert clear step ST11, from the previous-image holding section 120 of the storage device 111. The image data readout control section 145 acquires the image data of the previous image from the previous-image holding section 120 through the storage device control section 144, and outputs the data to the image signal generation section 146. The image signal generation section 146 generates an image signal on the basis of an inverted image of the image data of the input previous image, and outputs the generated image signal together with the timing signal to the data-line drive circuit 152. Further, the selection signal generation section 147 generates the selection signal under the control of the timing signal generation section 142, and outputs the generated selection signal together with the timing signal to the scan-line drive circuit 151.

The common power supply control section 143 outputs, to the common power supply 163, a command to supply the common electrode 25 with the reference potential GND.

Then, in the electro-optical panel 112, the image signal based on the inverted image of the previous image is input to the pixel electrode 24 of each pixel 10 through the scan-line drive circuit 151 to which the selection signal is input and the data-line drive circuit 152 to which the image signal is input. In addition, the reference potential GND is input to the common electrode 25. Thereby, the pixels 10, which were being displayed in white when the previous image is displayed, are changed to be displayed in black. That is, the invert clear step ST11 is executed, such that the entire screen of the display section 150 is displayed in black, thereby clearing the previous image.

Next, the overall control section 140 outputs a command to execute the all-white clear step ST12 to the timing signal generation section 142 and the common power supply control section 143.

The timing signal generation section 142 controls the image signal generation section 146 and the selection signal generation section 147. The timing signal generation section 142 causes the image signal generation section 146 to generate the image signal used in the all-white clear step ST12 and output the generated image signal together with the timing signal to the data-line drive circuit 152. Further, the timing signal generation section 142 causes the selection signal generation section 147 to generate the selection signal and the generated selection signal together with the timing signal to the scan-line drive circuit 151.

Then, in the electro-optical panel 112 the image signal with the low-level potential is input to each pixel electrode 24 of all pixels 10 through the scan-line drive circuit 151 to which the selection signal is input and the data-line drive circuit 152 to which the image signal is input. In addition, the reference potential GND is input from the common power supply 163 to the common electrode 25. That is, the all-white clear step ST12 is executed, such that the entire screen of the display section 150 is displayed in white.

Next, the overall control section 140 outputs a command to execute the image display step ST13 to the timing signal generation section 142 and the common power supply control section 143.

The timing signal generation section 142 outputs, to the image data readout control section 145, a command to read out the image data (the image data of the next image), which is used in the image display step ST13, from the next-image holding section 121 of the storage device 111. The image data readout control section 145 acquires the image data of the next image from the next-image holding section 121 through the storage device control section 144, and outputs the image signal generation section 146. The image signal generation section 146 generates an image signal on the basis of the image data of the input next image, and outputs the generated image signal together with the timing signal to the data-line drive circuit 152. Further, the selection signal generation section 147 generates the selection signal under the control of the timing signal generation section 142, and outputs the generated selection signal together with the timing signal to the scan-line drive circuit 151. In addition, the common power supply control section 143 outputs, to the common power supply 163, a command to supply the common electrode 25 with the reference potential GND.

Then, in the electro-optical panel 112 the image signal with the high-level potential is input to each pixel electrode 24 of pixels 10 to be displayed in black through the scan-line drive circuit 151 to which the selection signal is input and the data-line drive circuit 152 to which the image signal is input. In addition, the reference potential GND is input to the common electrode 25 from the common power supply 163. That is, the image display step ST13 is executed, such that the pixels 10 of a part of the display section 150, of which the entire screen is being displayed in white, are changed to be displayed in black, thereby displaying the next image on the display section 150.

When the display of the next image is terminated, the CPU 102 restarts the page change process shown in FIG. 4.

In step S108, the CPU 102 updates the control value c to a value which is obtained by decreasing the control value c by 1, and the process returns to step S103. Then, until it is determined in step S103 that the control value c is 0, the process from step S103 to step S108 is repeated. That is, by rewriting images only the number of times corresponding to the initial value of the control value c which is set in the pulse counter 114, plural pages are continuously displayed. At this time, in step S105, any drive sequence is selected from the drive sequences SQ11 to SQ13 in accordance with the control value c which temporally changes. Hence, in the electro-optical panel 112, different display operations are performed in accordance with the remaining number of pages displayed.

In the above-mentioned electronic book reader 100 according to the embodiment, when the button of the input device 113 is successively pressed, the initial value of the control value c, which corresponds to the number of the times the button is pressed, is set, and the pages, the number of which corresponds to the control value c, are sequentially displayed.

Then, each time the page is displayed one by one, that is, each time the image is rewritten once, it is possible to set a different drive sequence on the basis of the control value c while performing the operation to decrease the control value c by 1.

Specifically, when the control value c is a relatively large value ($c \geq N$), the drive sequence SQ13, which clears the previous image and displays the next image simultaneously, is selected. That is, when the remaining number of pages to be displayed is large, the display speed is the highest, and thus the drive sequence SQ13, in which the flashing of the display section 150 does not occur, is selected. In the drive sequence SQ13, since the image is overwritten in the display section 150, image lag tends to occur. However, since the current page is instantly changed to another page, the image lag is unlikely to provide a sense of discomfort to a user.

On the other hand, when the control value c is an intermediate value ($M \leq c < N$), the drive sequence SQ12 (SQ12A or SQ12B), which performs the clear operation once and then displays an image, is selected. That is, when the remaining number of pages to be displayed has been decreased, the drive sequence SQ12, which has a lower speed than the drive sequence SQ13 but is able to obtain the display in which image lag is small as compared with the drive sequence SQ13. Thereby, it is possible to make the contents of the page quite visible to a user.

Then, when the control value c is a small value ($1 \leq c < M$), the drive sequence SQ11, which performs the clear operation twice and then displays the next image, is selected. When the control value c is at least equal to the lower limit of the control value c for rewriting the image, the drive sequence SQ11 is selected. That is, at least for the page which is displayed last, the drive sequence SQ11, which is able to achieve high quality display in which image lag is hardly present, is selected. Since the drive sequence SQ11 has a large number of steps, the display speed is lowest, and flashing is caused by displaying the entire screen in white and displaying the entire screen in black, but a user is able to clearly view the contents of the target page.

As described above, according to the electronic book reader 100 of the embodiment, when the operation for continuously paging forward is performed, the drive sequence capable of high-speed image display is used, and at the final page at which the display is fixed, the drive sequence, which gives priority to the display quality, is used. Therefore, it is possible to satisfy both high-speed page change and high-quality display.

In the present example, the control value c is set to an integer, and the lower limit of the control value c for rewriting an image is set to 1. However, the lower limit of the control value c for rewriting an image is not limited to 1. In addition, it is not necessary that the control value c is an integer.

Second Embodiment

Hereinafter, a second embodiment will be described with reference to the accompanying drawings.

In the second embodiment, the operation configurations of the respective drive sequences and the data table referenced in step S104 are changed. Accordingly, since the other configurations are the same as those of the first embodiment, detailed description thereof will be omitted.

The electro-optical device according to the second embodiment is configured to change the electric potential of the common electrode 25 in accordance with the gray level displayed in each pixel 10. Hereinafter, detailed description will be given.

Figure 8A:
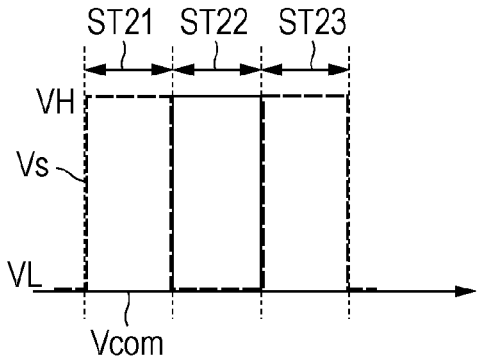
FIG. 8A is a diagram illustrating a drive waveform of an operation constituting a drive sequence.
Figure 8B:
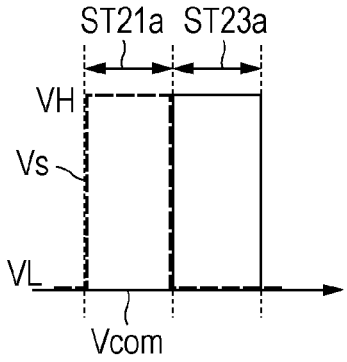
FIG. 8B is a diagram illustrating a drive waveform of an operation constituting the drive sequence.
Figure 8C:
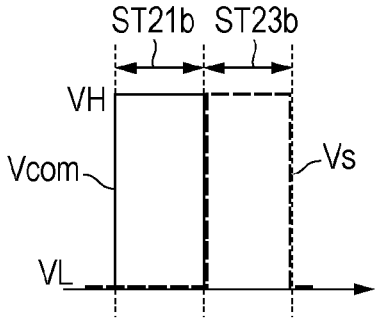
FIG. 8C is a diagram illustrating a drive waveform of an operation constituting the drive sequence.

Table 3 is a table showing a simple overview of the data table referenced in step S104. Further, Table 4 is a table showing configurations of the drive sequences shown in Table 3. In addition, FIGS. 8A to 8C are diagrams illustrating drive waveforms of the respective operations shown in Table 4.

TABLE 3

| CONTROL VALUE | DRIVE SEQUENCE |
|---|---|
| $1 \leq c < N$ | SQ21 |
| $c \geq N$ | SQ22 |

TABLE 4

| DRIVE SEQUENCE | | INVERT CLEAR | ALL-WHITE CLEAR | IMAGE DISPLAY |
|---|---|---|---|---|
| SQ21 | | ○ | ○ | ○ |
| SQ22 | A | ○ (ALL BLACK) | | ○ (WHITE COMPONENT WRITE) |
| | B | ○ (ALL WHITE) | | ○ (BLACK COMPONENT WRITE) |

Vcom = VL (AT THE TIME OF REWRITING BLACK), VH (AT THE TIME OF REWRITING WHITE)

In Table 3, N is a natural number of 2 or more, and is an integer which is appropriately set.

In the data table shown in Table 3, the control values c are classified into 2 levels, and the respective levels are associated with the drive sequences SQ21 and SQ22. The CPU 102 acquires the drive sequences SQ21 and SQ22 corresponding to the levels, to which the control values c belong, with reference to the data table using the control values c acquired in step S102.

For example, when the setting is made so that N=2, the drive sequence SQ22 is selected at the control value c of 2, and the drive sequence SQ21 is selected only at the control value c of 1.

The drive sequences SQ21 and SQ22 have differences in configurations of operations thereof executed in the electro-optical panel 112 as shown in Table 4. Hereinafter, the respective drive sequences will be described with reference to Table 4 and FIGS. 8A to 8C.

Drive Sequence SQ21

The drive sequence SQ21 is a drive sequence which is selected when the control value c belongs to the first level (1≤c<N). As shown in Table 4, the drive sequence SQ21 includes the invert clear step (the first clear operation), the all-white clear step (the second clear operation), and the image display step (the image display operation). Further, FIG. 8A shows respective input potentials of the pixel electrode 24 and the common electrode 25 in one of the pixels 10 of the display section 150, where ST21 corresponds to the invert clear step, ST22 corresponds to the all-white clear step, and ST23 corresponds to the image display step.

The invert clear step ST21 is, similarly to the invert clear step ST11, an operation which changes the entire screen (all pixels) of the display section 150 such that it is displayed in black by writing black to the pixels, which are being displayed in white, in the image (the previous image) which was being displayed on the electro-optical panel 112 right before the page change process. In the invert clear step ST21 shown in FIG. 8A, the high-level potential VH is input to each pixel electrode 24 (the electric potential Vs), and the low-level potential VL is input to each common electrode 25 (the electric potential Vcom). Thereby, the pixel electrode 24 has a higher potential than the common electrode 25, and each pixel 10 is changed from the white display to the black display.

In addition, in the invert clear step ST21, each pixel 10, which was being displayed in black, is not driven in the previous image. Hence, the electric potential (the low-level potential VL) equivalent to the electric potential Vcom of the common electrode 25 is input to the pixel electrode 24 of the pixel 10.

Next, in the all-white clear step ST22, the operation, which displays the entire screen of the display section 150 in white, is executed. As shown in FIG. 8A, in the all-white clear step ST22, the low-level potential VL is input to the pixel electrodes 24 of all the pixels 10, and the high-level potential VH is input to each common electrode 25 (the electric potential Vcom). Thereby, the pixel electrode 24 is held at the electric potential lower than that of the common electrode 25 (the electric potential Vcom), and all pixels 10 are displayed in white.

Next, in the image display step ST23, display is performed on the basis of the image data of the image (the next image) to be displayed next time on the display section 150. The image display step ST23 in the drive sequence SQ21 is for writing a single color similar to the image display step ST13 according to the first embodiment. That is, only the black display part of the next image is displayed on the display section 150 of which the entire screen is displayed in white in the all-white clear step ST22, thereby displaying the next image.

In each pixel 10 displayed in black in the image display step ST23, as shown in FIG. 8A, the high-level potential VH is input to the pixel electrode 24, and the low-level potential VL is input to the common electrode 25. On the other hand, the low-level potential VL equivalent to the electric potential Vcom of the common electrode 25 is input to the pixel electrode 24 of each pixel 10 which keeps being displayed in white in the image display step ST23.

Drive Sequence SQ22

The drive sequence SQ22 is a drive sequence which is selected when the control value c belongs to the second level (c≥N). As shown in Table 4, the drive sequence SQ22 includes the invert clear step (the clear operation) and the image display step (the image display operation).

FIGS. 8B and 8C show two kinds of modes (SQ22A and SQ22B) of the drive sequence SQ22, and show the waveforms of the inputs to the pixel electrode 24 and the common electrode 25 in one of the pixels 10 of the display section 150 in the respective modes. In FIGS. 8B and 8C, ST21*a* and ST21*b* correspond to the invert clear step, and ST23*a* and ST23*b* correspond to image display step.

First, in the invert clear step ST21*a* of the drive sequence SQ22A shown in FIG. 8B, the entire screen (all pixels) of the display section 150 is changed so as to be displayed in black by writing black to the pixels, which are being displayed in white, in the image (the previous image) which was being displayed on the electro-optical panel 112 right before the page change process (the inverted all-black clear).

In the case of the invert clear step ST21*a* shown in FIG. 8B, contrary to the first embodiment, the high-level potential VH is input to each pixel electrode 24 (the electric potential Vs), and the low-level potential VL is input to the common electrode 25 (the electric potential Vcom), thereby displaying the pixel 10 in black. Further, at this time, in each pixel 10 which is displayed in black in the previous image, the low-level potential VL equivalent to the electric potential Vcom of the common electrode 25 is input to the pixel electrode 24, and thus the pixel 10 is not driven.

Next, in the image display step ST23*a*, display is performed on the basis of the image data of the next image to be displayed next time on the display section 150. Specifically the white component (the white display part) of the next image is written in the display section 150 of which the entire screen is displayed in black in the invert clear step ST21*a*. In each pixel 10 which is displayed in white in such a step, as shown in FIG. 8B, the low-level potential VL is input to the pixel electrode 24, and the high-level potential VH is input to the common electrode 25. On the other hand, in each pixel 10 in which there is no change in the display in the image display step ST23*a*, the high-level potential VH equivalent to the electric potential Vcom of the common electrode 25 is input to the pixel electrode 24.

On the other hand, in the drive sequence SQ22B, in the invert clear step ST21*b*, the all-white clear (the inverted all-white clear) is performed on the display section 150 by using the inverted image of the previous image, and then the black component of the next image is written in the image display step ST23*b*. Accordingly, as shown in FIG. 8C, in the invert clear step ST21*b*, the low-level potential VL is input to the pixel electrode 24 of each pixel 10 which is driven, and the high-level potential VH is input to the common electrode 25. In the image display step ST23*b*, the high-level potential VH is input to the pixel electrode 24 of each pixel 10 which is driven (which is displayed in black), and the low-level potential VL is input to the common electrode 25.

Similarly to the first embodiment, it is preferable that at least any one of the drive sequences SQ22A and SQ22B should be provided. However, the drive sequences may be configured to be changeable in accordance with a scene.

As described above, also in the electro-optical device according to the first modified example, when the button of the input device 113 is successively pressed, by setting the initial value of the control value c which corresponds to the number of the times the button is pressed, it is possible to sequentially display the pages the number of which corresponds to the control value c. Then, each time the page is displayed one by one, that is, each time the image is rewritten once, a different drive sequence is set on the basis of the control value c while performing the operation to decrease the control value c by 1.

Specifically, when the control value c is a relatively large value (c≥N), the drive sequence SQ22 (SQ22A or SQ22B), which performs the clear operation once and then displays an image, is selected, thereby displaying an image at a high speed. On the other hand, when the control value c is a small value (1≤c<N), the drive sequence SQ21, which performs the clear operation twice and then displays the next image, is selected. That is, at least for the page which is displayed last, it is possible to achieve high quality display in which image lag is hardly present.

As described above, also in the electro-optical device according to the first modified example, when the operation for continuously paging forward is performed, the drive sequence capable of high-speed image display is used, and at the final page at which the display is fixed, the drive sequence, which gives priority to the display quality, is used. Therefore, it is possible to satisfy both high-speed page change and high-quality display.

Further, in the electro-optical device according to the first modified example, the low-level potential VL is input to the common electrode 25 when each pixel 10 is displayed in black, and the high-level potential VH is input thereto when each pixel 10 is displayed in white. Accordingly, black and white are not simultaneously written in the display section 150, and thus it is difficult to employ the drive sequence SQ13 of the first embodiment.

On the other hand, a potential difference between the high-level potential VH and the low-level potential VL can be directly used as a potential difference between the pixel electrode 24 and the common electrode 25. Hence, as compared with the driving method used in the first embodiment, it is possible to obtain an advantage that the drive voltage applied to the electro-optical material layer 26 can be set to be high.

That is, assuming that the high-level potential VH and the low-level potential VL are equal to those of the first embodiment, in the electro-optical device according to the first modified example, it is possible to apply a voltage, which is two times that of the first embodiment, to the electro-optical material layer 26. Accordingly, in the electro-optical device according to the second embodiment, by shortening the time period of applying a voltage to the electro-optical material layer 26, it is also possible to display an image at a high speed.

Third Embodiment

Next, the electro-optical device according to the third embodiment is configured to be able to change to a drive sequence with a different method of driving the common electrode 25. Hereinafter, a detailed description of the third embodiment will be given.

Figure 9A:
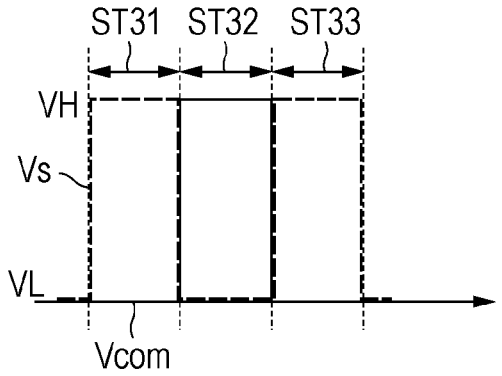
FIG. 9A is a diagram illustrating a drive waveform of an operation constituting a drive sequence.
Figure 9B:
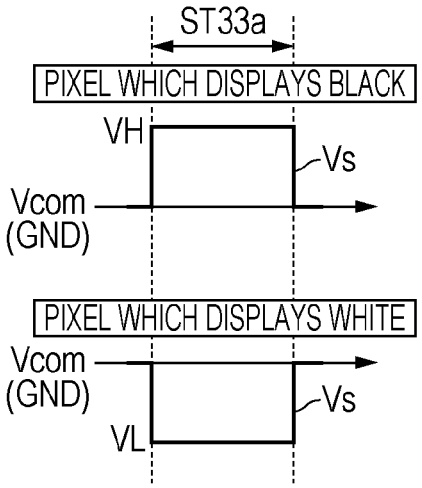
FIG. 9B is a diagram illustrating a drive waveform of an operation constituting the drive sequence.

Table 5 is a table showing a simple overview of the data table referenced in step S104. Further, Table 6 is a table showing configurations of the drive sequences shown in Table 5. In addition, FIGS. 9A and 9B are diagrams illustrating drive waveforms of the respective operations shown in Table 6.

TABLE 5

| CONTROL VALUE | DRIVE SEQUENCE |
|---|---|
| 1 ≤ c < N | SQ31 |
| c ≥ N | SQ32 |

TABLE 6

| | | | IMAGE DISPLAY | |
|---|---|---|---|---|
| DRIVE SEQUENCE | INVERT CLEAR | ALL-WHITE CLEAR | SINGLE COLOR COMPONENT WRITE | DIFFERENCE WRITE |
| SQ31 | ○ | ○ | ○ | |
| SQ33 | | | | ○ |

SQ31: Vcom = VL (AT THE TIME OF REWRITING BLACK), VH (AT THE TIME OF REWRITING WHITE)
SQ32: Vcom = REFERENCE POTENTIAL (0 V) FIXED In Table 5, N is a natural number of 2 or more, and is an integer which is appropriately set.

In the data table shown in Table 5, the control values c are classified into 2 levels, and the respective levels are associated with the drive sequences SQ31 and SQ32. The CPU 102 acquires the drive sequences SQ31 and SQ32 corresponding to the levels, to which the control values c belong, with reference to the data table using the control values c acquired in step S102.

For example, when the setting is made so that N=2, the drive sequence SQ32 is selected at the control value c of 2, and the drive sequence SQ31 is selected only at the control value c of 1.

The drive sequences SQ31 and SQ32 have differences in configurations of operations thereof executed in the electro-optical panel 112 as shown in Table 6. Hereinafter, the respective drive sequences will be described with reference to Table 6 and FIGS. 9A and 9B.

Drive Sequence SQ31

The drive sequence SQ31 is a drive sequence which is selected when the control value c belongs to the first level (1≤c<N). As shown in Table 6, the drive sequence SQ31 is the same as the drive sequence SQ21 of the first modified example.

As shown in FIG. 9A, the drive sequence SQ31 includes the invert clear step (the first clear operation) ST31, the all-white clear step (the second clear operation) ST32, and the image display step (the image display operation) ST33. Since the operations of the electro-optical panel 112 in the respective steps are the same as those of the first modified example, description thereof will be omitted herein.

Drive Sequence SQ32

The drive sequence SQ32 is a drive sequence which is selected when the control value c belongs to the second level (c≥N). As shown in Table 6, the drive sequence SQ32 is the same as the drive sequence SQ13 of the first embodiment.

As shown in FIG. 9B, the drive sequence SQ32 is formed of the image display step ST33*a* of clearing the previous image and writing the next image simultaneously by driving the pixels 10 of the black display part and the pixels 10 of the white display part at the same time. Since the operations of the electro-optical panel 112 in the respective steps are the same as those of the first embodiment, description thereof will be omitted herein.

As described above, also in the electro-optical device according to the second modified example, when the button of the input device 113 is successively pressed, by setting the initial value of the control value c which corresponds to the number of the times the button is pressed, it is possible to sequentially display the pages the number of which corresponds to the control value c. Then, each time the page is displayed one by one, that is, each time the image is rewritten once, a different drive sequence is set on the basis of the control value c while performing the operation to decrease the control value c by 1.

Specifically, when the control value c is a relatively large value (c≥N), the drive sequence SQ32, which clears the previous image and displays the next image simultaneously, is selected, thereby displaying an image at a high speed. On the other hand, when the control value c is a small value (1≤c<N), the drive sequence SQ31, which performs the clear operation twice and then displays the next image, is selected. That is, at least for the page which is displayed last, it is possible to achieve high quality display in which image lag is hardly present.

As described above, also in the electro-optical device according to the second modified example, when the operation for continuously paging forward is performed, the drive sequence capable of high-speed image display is used, and at the final page at which the display is fixed, the drive sequence, which gives priority to the display quality, is used. Therefore, it is possible to satisfy both high-speed page change and high-quality display.

What is claimed is:

1. A method of driving multi-stable display device including a plurality of pixels, comprising:

receiving a number of images to be displayed as instructed by a user;

displaying a part of the number of the images using a first driving method based on the number of images; and displaying remains of the number of images using a second driving method after the displaying in the first driving method, wherein the second driving method is performed at a lower speed than the first driving method such that, at each of the pixels, a time required for rewriting in the second driving method is greater than a time required for rewriting in the first drive method; and wherein the second driving method is selected from a plurality of driving methods that are each performed at different speeds in comparison to the speed of the first driving method.

2. The method according to claim 1, wherein the second driving method includes a clear operation and an image display operation, the first driving method includes an image display operation and does not include a clear operation.

3. The method according to claim 1, wherein the first driving method execute a difference image display operation which displays a difference image between a new image and the image displayed on the display section.

4. The method according to claim 1, wherein the remains of the number of is a final image at which the display is fixed.

5. The method according to claim 1, wherein a control value c is changed based on the received number of images to be displayed as instructed by the user.

6. The method according to claim 5, wherein the second driving method selected when the control value c is equal to a predetermined lower limit.

7. A method of driving multi-stable display device including a plurality of pixels, comprising:

receiving a number of images to be displayed as instructed by a user;

displaying a part of the number of the images using a first driving method based on the number of images;

displaying a part of remains of the number of the images using a second driving method after the displaying in the first driving method; and displaying remains of the part of remains of the number of the images in a third driving method after the displaying in the second driving method, wherein the third driving method has a lower speed than the first driving method such that, at each of the pixels, a time required for rewriting in the third driving method is greater than a time required for rewriting in the first drive method; and wherein each of the first, second, and third driving methods are performed at different speeds.

8. The method according to claim 7, wherein the second driving method includes a clear operation and an image display operation, the first driving method includes an image display operation and does not include a clear operation.

9. The method according to claim 7, wherein the first driving method execute a difference image display operation which displays a difference image between a new image and the image displayed on the display section.

10. The method according to claim 7, wherein the remains of the number of images is a final image at which the display is fixed.

11. The method according to claim 7, wherein the second driving method is selected from a plurality of driving methods that are each performed at different speeds.

12. The method according to claim 11, wherein a control value c is changed based on the received number of images to be displayed as instructed by the user.

13. The method according to claim 12, wherein the second driving method selected when the control value c is equal to a predetermined lower limit.

14. The method according to claim 7, wherein the display device includes a display section having a plurality of pixels;

a control value acquisition section that acquires an initial value of a control value c which is used when one of the images is displayed on the display section;

a calculation section that decreases the control value c whenever the image of the display section is rewritten; and a control section that selects the third driving method from a plurality of driving methods on the basis of the control value c and rewrites the image of the display section by using the third driving method.

* * * * *